US005341611A

United States Patent [19]

Lewis

[11] Patent Number: 5,341,611

[45] Date of Patent: Aug. 30, 1994

[54] STRUCTURAL FRAMING SYSTEM FOR BUILDINGS

[75] Inventor: Robert C. Lewis, Valley Ford, Wash.

[73] Assignee: Spokane Structures, Inc., Spokane, Wash.

[21] Appl. No.: 22,068

[22] Filed: Feb. 24, 1993

[51] Int. Cl.[5] ..... E04B 7/02

[52] U.S. Cl. ..... 52/90.1; 52/643

[58] Field of Search ..... 52/90.1, 94, 93.1, 92.3, 52/639, 299, 643

[56] References Cited

U.S. PATENT DOCUMENTS

| | | | |
|---|---|---|---|
| 1,262,156 | 4/1918 | Adrian | 52/633 |
| 1,673,788 | 6/1928 | Hobson | 52/94 |
| 2,375,910 | 5/1945 | Forward | 52/92.3 |
| 3,008,195 | 11/1961 | Coffey | 52/664 |
| 4,441,287 | 4/1984 | Muir | 52/93 |
| 4,457,118 | 7/1984 | Bowen | 52/292 |
| 4,677,806 | 7/1987 | Tuomi | 52/642 |
| 5,083,404 | 1/1992 | Schulte | 52/167 R |

FOREIGN PATENT DOCUMENTS

| | | | |
|---|---|---|---|
| 616181 | 10/1926 | France | 52/90.1 |
| 501340 | 1/1930 | France | 52/639 |
| 860403 | 2/1941 | France | 52/90.1 |
| 411556 | 1/1945 | Italy | 52/90.1 |
| 151604 | 12/1921 | United Kingdom . | |
| 760583 | 11/1956 | United Kingdom | 52/90.1 |

OTHER PUBLICATIONS

Sikeston Buildings, Inc. brochure (1990).

Morton Buildings, Inc. brochure (date unknown).

*Primary Examiner*—James L. Ridgill, Jr.

*Attorney, Agent, or Firm*—Wells, St. John, Roberts, Gregory & Matkin

[57] ABSTRACT

A structural frame for a building including multiple truss members and multiple column members. The column members are comprised of multiple upstanding support members and are connected to the truss members by means of a mortise-and-tenon type connection. A plurality of T-purlins, having face boards and cross brace boards, interconnect the rafters of the truss members and the joists of the truss members. A face girt is secured to the lower ends of the rafters so that an external roof structure can be attached to the girts at the same slope and elevation from the rafters as compared to the face boards of the T-purlins.

12 Claims, 6 Drawing Sheets

STRUCTURAL FRAMING SYSTEM FOR BUILDINGS

TECHNICAL FIELD

This invention relates to buildings, and more particularly to framing systems for buildings.

BACKGROUND OF THE INVENTION

Many different types of framing systems and techniques have been used over the years to develop a variety of structural frames for buildings. Specific framing techniques have been established for a variety of building structures such as floors, walls, and roofs. Various types of wood and metal framing have been developed for each of these specific structures. Further, there are many different types of structures that are framed, such as residential housing, steel buildings, and open wall structures.

With respect to roof framing, there are several framing methods have been traditionally used to construct different styles of roofs. Several factors influence roof framing systems. Roof construction must be strong in order to withstand adverse weather conditions, such as snow, wind, and rain. Roofing members must be securely fastened to each other to provide continuity across the building and must be securely anchored to exterior walls of the building. In addition, the roof should provide a pleasing aesthetic appearance. There are several known roofing styles, including a flat roof, shed roof, gable roof, hip roof, mansard roof, gambrel roof, and butterfly roof. These roof styles have been developed utilizing various framing techniques.

Exterior side walls must be specially designed and constructed to support the roof load. The side walls also serve to anchor the roof to the building frame. The exterior side walls further provide an area for attaching wall coverings, and they also provide a base for constructing interior walls, which may or may not support the roof load. Among other important characteristics, a suitable wall construction will have appropriate stiffness, nail-holding power, be easy to work with, and prevent damage (e.g., warping and corrosion) from exposure to the environment.

Traditional framing techniques have proven deficient in many areas. For example, traditional methods of joining lower ends of a roof truss to a wall construction have failed to provide a adequate structure and surface area on which an external roof structure can be mounted. Preferably, the underlying roof support structure should provide a sufficient area for mounting the exterior roof structure, and should be at a constant plane where support for the external roof structure is desired.

Traditionally, rafters have either been notched to fit over vertical side walls (e.g., where extended caves are desired), or a facia board is connected to the lower end of the rafters to extend above the roof height in an attempt to correspond with the elevation (relative to the sloped roof) of the roof support structures on which an exterior roof structure is to be secured.

One problem with this type of traditional construction is that the top edge of the facia board is substantially horizontal and does not correspond to the slope of the roof. Hence, when the roofing material is laid down against the rafters and the facia board, there is a gap between the roofing material and the facia board. When a fastener is driven through the exterior roof structure and into the top surface of the facia board, the external roof member is damaged and may cause a leak in the roof.

If, for example, aluminum sheets are used for the external roof structure, the aluminum material will bend and become indented when the fastener is driven through the top sheet. This indentation or bend may create a reverse flow for water collecting on the roof and may direct water into the hole created by the fastener.

Still another problem with respect to conventional framing techniques relates to the column construction. Most traditional columns are made of a single piece of wood material. When a traditional column made of a single piece of wood (e.g., a 6 inch by 6 inch piece) is chemically treated, the chemical will penetrate only a limited distance from the outside of the piece of wood and will not reach the central portion of the piece of wood.

Another problem arises with respect to defects, such as knots or fissures along the wood grain. When a single piece of wood is used for a column, the defect may render the column subject to failure at that particular location.

The inventive system incorporates a variety of novel features and aspects to provide a complete structural framing system for buildings. This system results in a strong, effective building frame while providing solutions to the above-described problems. Other features and advantages of the invention will become apparent from the detailed description which follows.

BRIEF DESCRIPTION OF THE DRAWINGS

One or more preferred forms of the invention are described herein with reference to the accompanying drawings. The drawings are briefly described below.

DETAILED DESCRIPTION OF THE PREFERRED EMBODIMENTS

Figure 1:
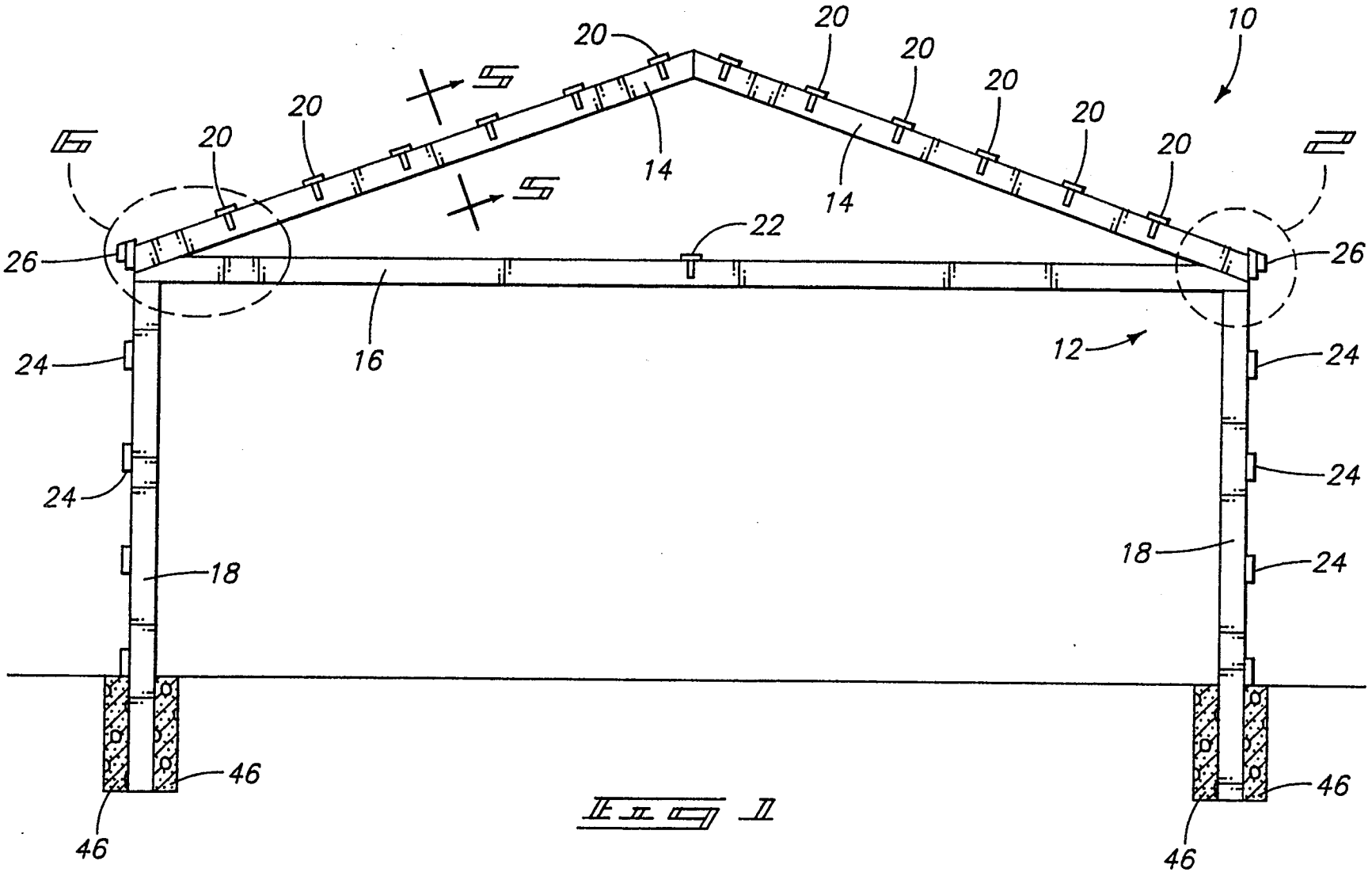
FIG. 1 is a sectional side elevational view of a preferred embodiment of a structural frame for a building constructed in accordance with the structural framing system of the present invention.

This disclosure of the invention is submitted in furtherance of the constitutional purposes of the U.S. Patent Laws "to promote the progress of science and useful arts" (Article 1, Section 8).

The present invention involves a system for building framed structures for various types of buildings, including residential buildings, office buildings, and pole buildings. This invention generally involves a total framing system for buildings, which includes a framed structure 10 having generally a plurality of roof truss members 12, multiple upstanding columns 18 for supporting for the roof truss members 12, a plurality of cross braces in the form of T-purlins 20 for providing lateral support and stability to the truss members as well as a mounting location for an external roof structure, and a beveled eave girt construction 26 for providing a peripheral edge for securing the external roof structure.

As shown in FIG. 1, each roof truss member 12 is comprised of a opposed rafters 14 joining at an apex and sloping downwardly opposite one another toward lower ends of the truss member. The rafters 14 are joined at the lower ends by a joist 16. The joist 16 may be comprised of a single piece of wood, or several pieces coupled together.

Figure 3:
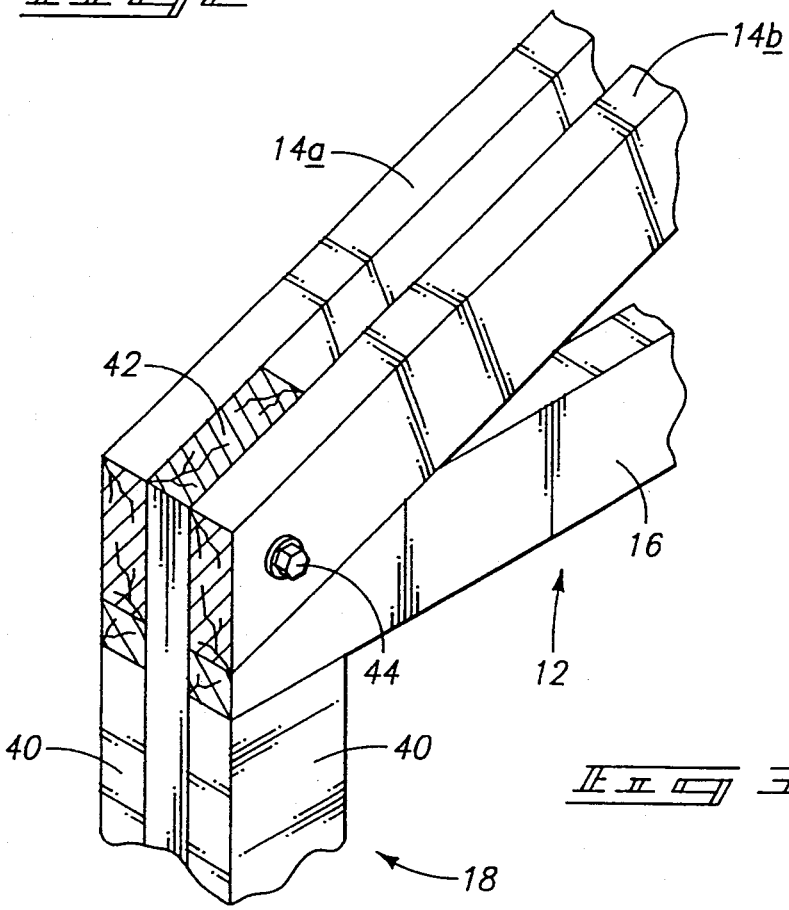
FIG. 3 is a partial perspective view of a preferred embodiment of a column-to-truss connection according to the present invention.
Figure 4:
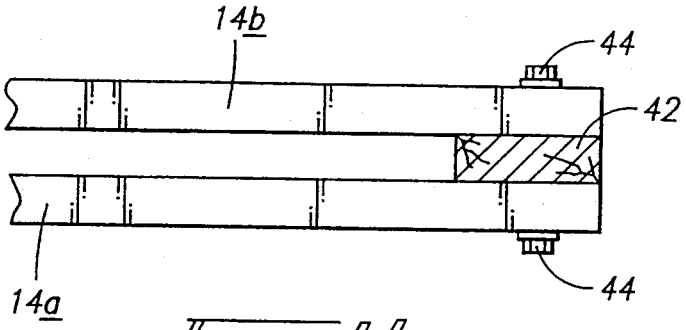
FIG. 4 is a top view of the column-to-truss connection shown in FIG. 3.
Figure 5:
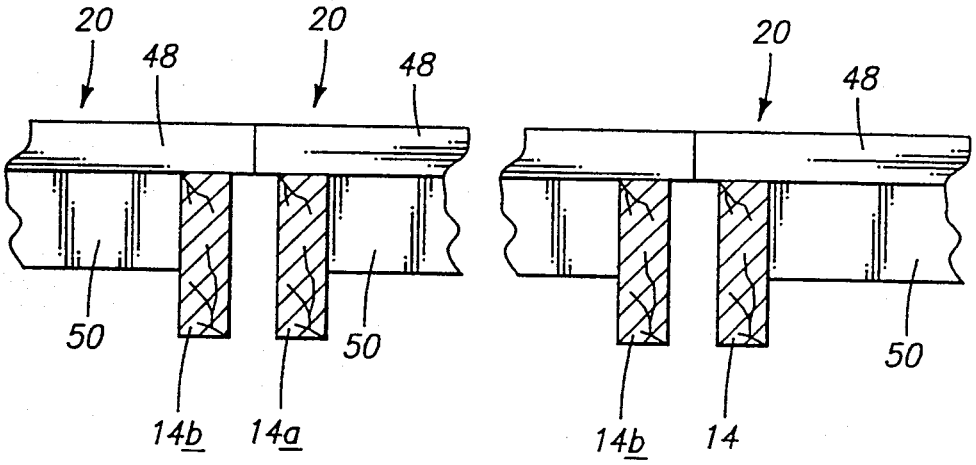
FIG. 5 is a partial sectional view, taken along the line 5—5 of FIG. 1, showing a preferred embodiment of a T-purlin constructed according to the present invention.

As shown in FIGS. 3–5, a preferred embodiment of the roof truss member 14 includes dual rafters 14*a*, 14*b*. A dual rafter construction provides a substantially stronger truss as compared to a single rafter truss construction. Typically, the rafters will be positioned at 8, 10, or 12 foot centers.

Referring to FIG. 3, the column assembly 18 is advantageously constructed of a plurality of upstanding support structures including a pair of outer support members 40 and an inner upstanding support member 42. The inner support member 42 has a tongue portion which extends above the combined column assembly at a top end of the column assembly and passes between the dual rafters 14*a*, 14*b*. The inner support member has a top end which is angled to correspond with the slope angle of the rafters.

The column assembly 18 is constructed in a manner to allow the inner support member 42 to extend through the dual rafters 14*a*, 14*b* so that the top surface of the inner support member lies in a plane which corresponds to the top of the rafters. The column assembly 18 may be secured to the truss assembly 12 by means of conventional fasteners 44. Although a single fastener is shown in the preferred embodiment, multiple fasteners could be used to secure the truss assemblies to the column assemblies.

Preferably, the fastener 44 will extend through the dual rafters 14*a*, 14*b* and the inner support member 42 to compress the inner support member between the dual rafters. This construction is similar to a mortise and tenon type of construction wherein the tongue portion of the inner support member 42 acts as a tenon and the space between the dual rafters 14*a*, 14*b* acts as the mortise.

The inner and outer support members of the column assembly are preferably laminated together to advantageously provide a stronger column assembly. The inner and outer support members are engineered to be laminated together using fasteners (e.g., 12d galvanized nails) appropriately spaced and inserted into the members while the members are compressed together. There are several advantages to laminated columns as compared to columns made of a single piece of material. First, the multiple upstanding support members 40, 42, preferably made of wood, necessarily have flaws (e.g., a knot) or weak spots along the wood grain. When two or more pieces are laminated together, any flaws in the side-by-side pieces of wood will not be continuous throughout the width of the column. This adds a tremendous amount of strength to the column assembly.

A second advantage relates to treating the column assembly. A preferred embodiment of the present involves upstanding support members 40, 42 which are chemically treated to prevent erosion from the elements. Typically, the wood is pressure treated with a conventional, corrosion-resistant chemical. If a one-piece column is treated, such as a commonly used 6 inch by 6 inch column, the pressurized chemical will penetrate into only a limited portion of the periphery of the column, and will not reach the innermost regions of the column. If, however, smaller wood pieces (e.g., 2 inch by 6 inch pieces or 2 inch by 8 inch pieces) are subjected to traditional pressure chemical treatment, complete penetration into the wood results.

The column construction of the present invention provides excellent vertical support for the roof structure. As shown in FIG. 1, the column assembly may be secured within a hole in the ground by any suitable means, such as concrete 46.

Figure 6:
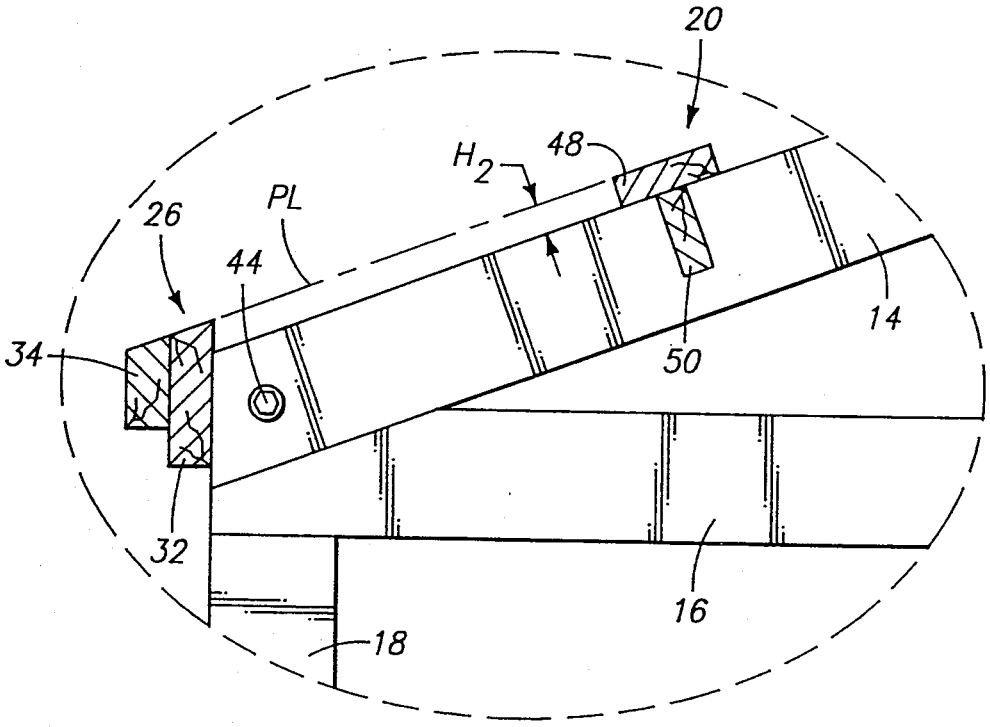
FIG. 6 is an enlarged view, taken from the area 6 of FIG. 1, of a preferred embodiment of an external roof structure mounting surface constructed according to the present invention.
Figure 7:
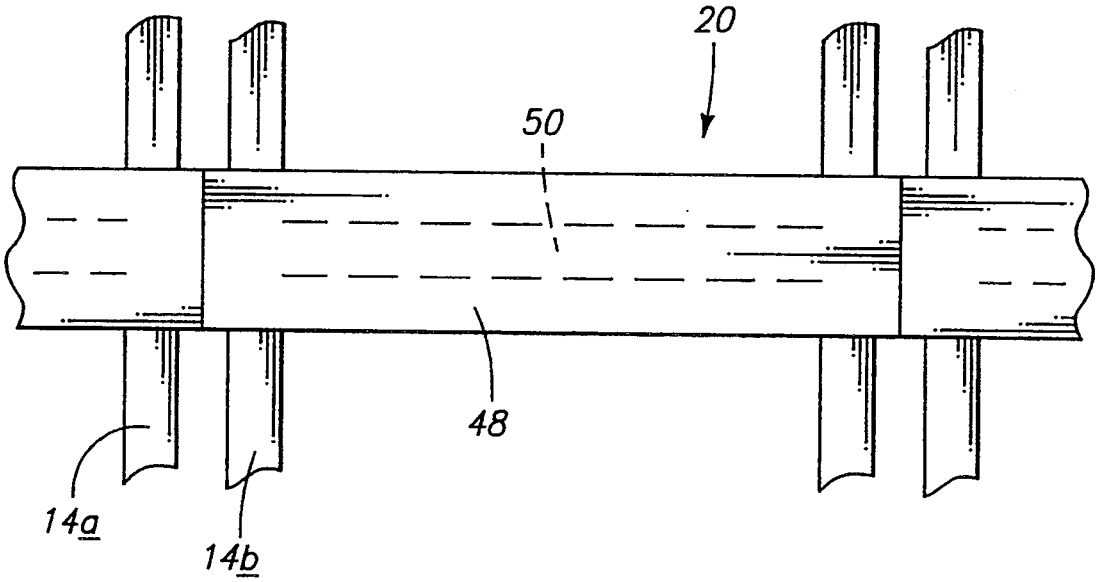
FIG. 7 is a top, perpendicular view of the T-purlins coupled to the rafters according to the present invention.

The framed structure 10 further comprises a plurality of cross brace members in the form of rafter T-purlins 20 and joist T-purlins 22 for interconnecting the rafters and joists and providing lateral stability to the framed structure. As shown in FIGS. 5 and 6, the T-purlins comprise a face board 48 which is secured using conventional fasteners to the rafters 14. The face board provides an outer support surface against which an external roof member may be mounted. A perpendicular cross brace board 50 is secured to the face board 48, also using conventional fasteners. The cross brace board 50 is secured in an abutting relationship between adjacent rafters.

The T-purlin construction results in a cross brace that is twice as strong as conventional cross braces because of the orientation of the respective wood grains. This extra strength improves the strength of the T-purlin across the span between rafters and allows greater spacing between rafters. Further, the T-purlin construction enables greater resistance of shear stresses on the framed structure 10 as compared to conventional cross braces. The T-purlins also provide extra support surface area as well as depth at the rafter locations for securing an external roof structure.

Figure 10:
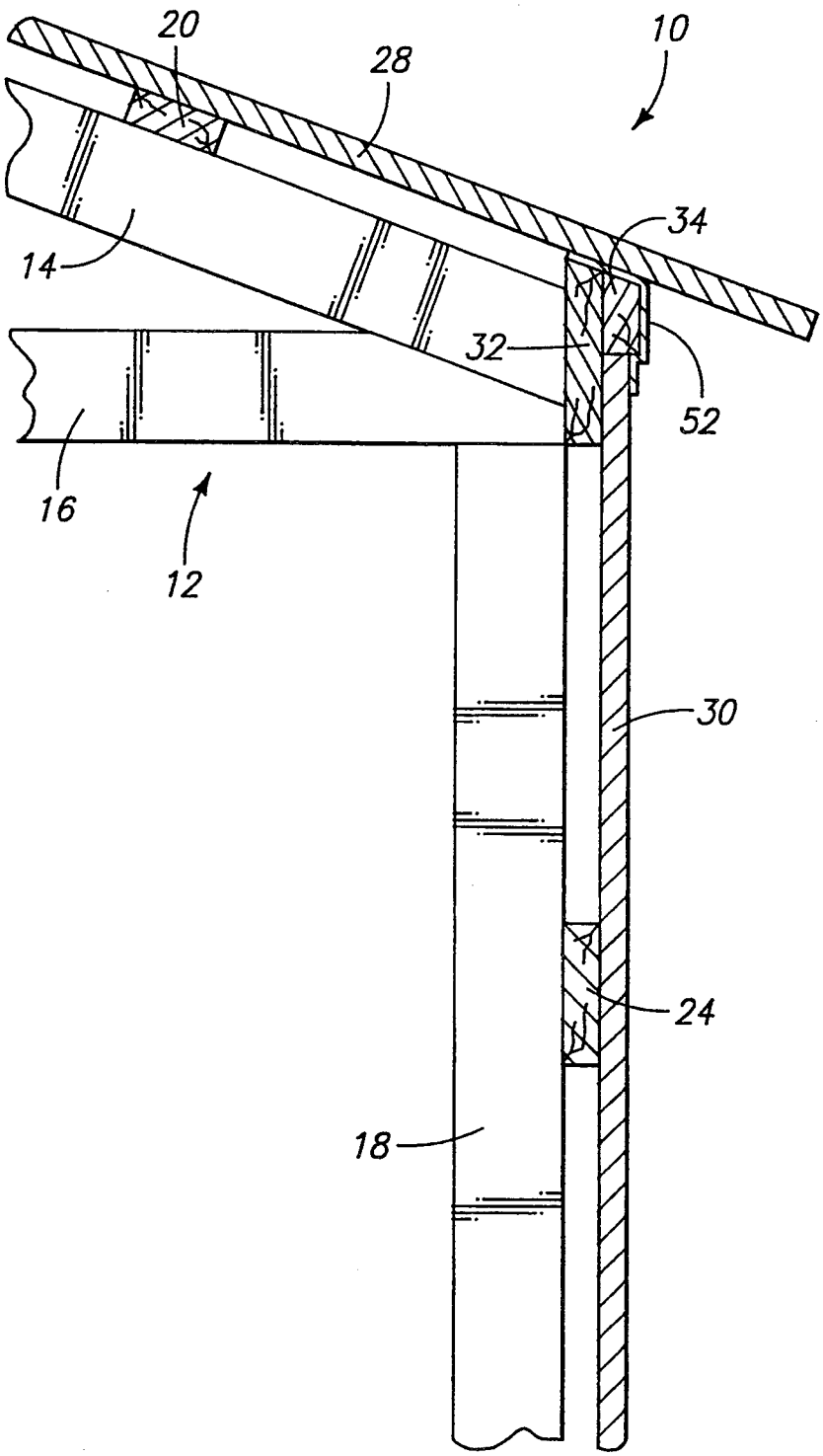
FIG. 10 is a partial sectional side elevational view of a structural framing system for buildings, including the preferred embodiment of the beveled eave girt construction, according to the present invention.

As shown in FIGS. 1 and 10, a plurality of side wall girts 24 are mounted to the column assemblies 18 to provide an area for mounting siding. The side wall girts 24 may be mounted to the columns using conventional fasteners.

Figure 2:
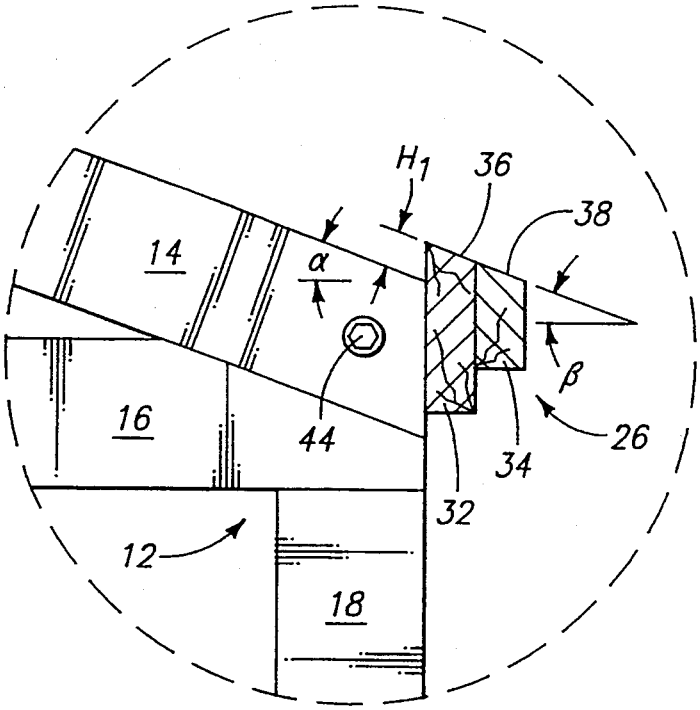
FIG. 2 is an enlarged view, taken from area 2 of FIG. 1, of a preferred embodiment of a beveled eave girt constructed according to the present invention.

With reference to FIG. 2, the beveled eave girts 26 comprise a girt block 32 and a cornice piece 34. The girt block 32 has a beveled edge in the form of a sloped top mounting surface 36. The cornice piece has a similar sloped top mounting surface 38. In a preferred embodiment, the combined transverse distance across the sloped mounting surfaces 36, 38 is three inches. This provides a substantially improved peripheral surface area of the framed roof structure to which an external roof structure 28 (FIG. 10) may be mounted.

Referring to FIGS. 2 and 6, when the girt block 32 and the cornice piece 34 are joined together, the top surfaces 36, 38 provide a continuous surface at a desired height $H_1$ for mounting an external roof structure 28 (FIG. 10). FIG. 2 shows a preferred embodiment of the beveled eave girt 26. The top mounting surfaces 36, 38 lie substantially in the same plane to form a continuous beveled edge, which has a slope defined by angle $\alpha$. Angle $\alpha$ corresponds substantially to the angle $\beta$ defined by the slope of the rafters 14.

That angle $\alpha$ and angle $\beta$ correspond substantially to one another renders the present system highly advantageous for mounting an external roof structure, as shown in FIG. 10. A face board of a T-purlin 20 lies against the top surface of the rafter 14. Hence, the top surface of the face board is also sloped at an angle which corresponds substantially to the slope angle $\beta$ of the edge girt 26 (FIG. 2).

Referring to FIG. 10, since the height $H_1$ that the girt 26 extends above the top surface of the rafters 14 and corresponds substantially to the height $H_2$ of the rafter T-purlins 20, the top mounting surface of the face girt 26 will lie in substantially the same plane PL as the support surface of the face board of the T-purlin 20. Accordingly, the external roof member 28, when positioned upon the support surface of the T-purlins 20 and the mounting surface of the cave girt 26, will be supported in one plane PL. In this preferred embodiment, the entire surface areas of the eave girt top mounting surface and the face board support surface provide a support base in a common plane PL for supporting an external roof structure 28.

Figure 8:
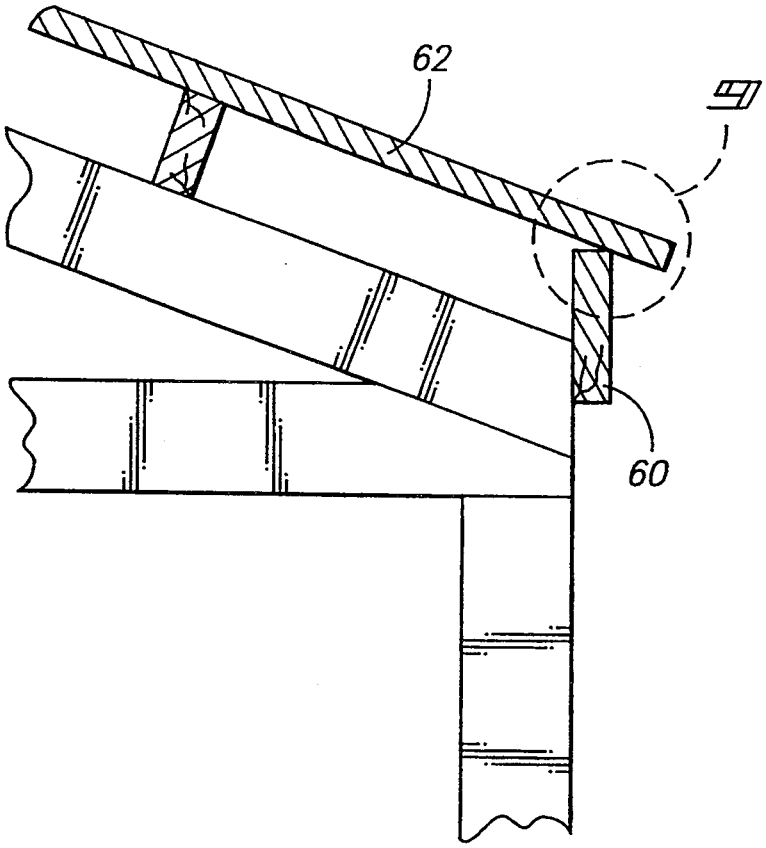
FIG 8 PRIOR ART
FIG. 8 is a partial sectional side elevational view of a prior art external roof structure mounting arrangement.
Figure 9:
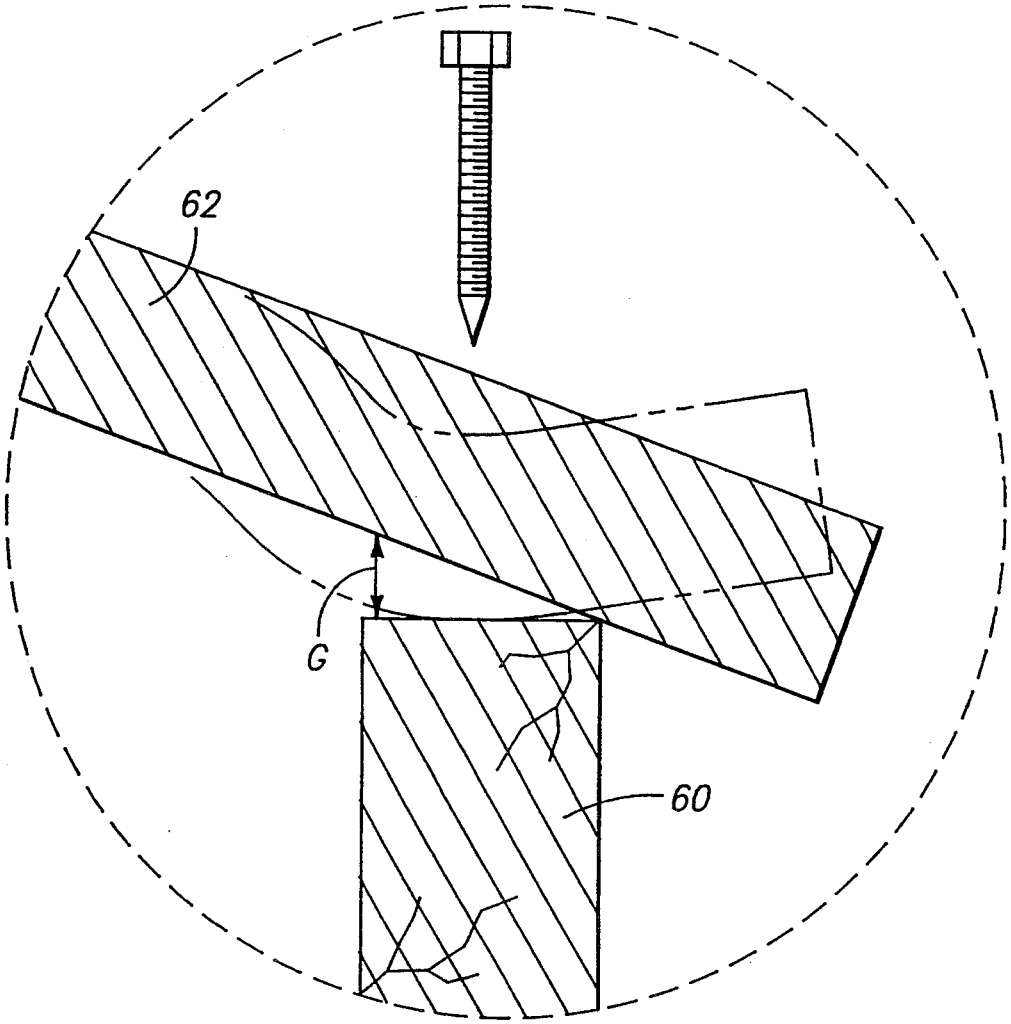
FIG 9 PRIOR ART
FIG. 9 is an enlarged view, taken from the area 9 of FIG. 8, of the prior art external roof structure mounting arrangement.

Referring now to FIGS. 8 and 9, the prior art has traditionally presented a problem with respect to mounting a roof structure on top of a substantially horizontal top surface of a fascia 60. When the roof material 62 is placed on top of the fascia 60, a gap G is created between the top surface of fascia 60 and the bottom surface of the roofing material 62. When a screw, nail, or other fastener is driven down into the fascia, the metal roof material becomes bent and indented (as shown in phantom lines in FIG. 9), causing water to run backward toward the nail hole and allowing water to leak into the inside of the building structure.

In the present invention, a continuous surface is provided by top mounting surfaces 36, 38 (FIG. 2) and there is no gap G between the bottom surface of the external roof structure 28 and the top mounting surfaces of the eave girt 26. This construction also advantageously provides increased surface area (as compared to traditional structures) for mounting the roof member 28 to the periphery of the framed structure 10.

As shown in FIG. 10, a preformed, customized, flashing 52 can be mounted to the cornice piece 34 prior to installing the roofing material 28. The flashing would prevent the environmental elements from damaging the building structure at the location where the roof material 28 meets the eave girt members 32, 34.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately .interpreted in accordance with the doctrine of equivalents.

I claim:

1. A structural framing system for buildings, comprising:

a plurality of dual roof truss members, each truss member comprising opposed sloping rafters and an interconnecting joist, the rafters being connected to one another at an apex and sloping downwardly away from one another and terminating at opposite, lower ends of said truss member;

a plurality of upstanding column assemblies supporting said dual roof truss members, each said column assembly having a top end, said dual roof truss members being secured to the top ends of the column assemblies, wherein each column assembly comprises a plurality of upstanding support members including opposed outside members and an inside member, said support members being secured to one another, said outside members being shorter than said inside member, said inside member extending upwardly through said dual roof truss members, said inside member having an angled top surface which corresponds with the slope of the dual roof truss members, said outside members providing surfaces to support a vertical load imparted by the dual truss members;

a plurality of cross brace members secured between said truss members, said cross brace members providing lateral support to the building structure and providing an outer support surface for attaching an exterior roof structure, the cross brace members being T-purlins, each T-purlin having a face board and a cross brace board, the face boards extending across the dual roof truss members and being secured to the top of both rafters of said dual truss members, each cross brace board being secured between adjacent dual truss members;

an eave girt comprising multiple girt members coupled to one another, the girt members being coupled to the lower ends of said truss members, said girt members forming contiguous sloped mounting surfaces which lie in a common plane with said support surfaces of said cross brace members such that the entire surface areas of said girt top mounting surfaces and said outer support surfaces of said cross brace members provide a support base in said common plane for supporting an exterior roof structure.

2. The structural framing system according to claim 1 wherein the outside and inside members of the column assembly are completely treated along their entire respective lengths and throughout their respective middle portions with a chemical prior to being secured to one another such that the chemical penetrates inside all interior portions of said outside and inside members.

3. The structural framing system according to claim 1 wherein the top mounting surface of the eave girt has a slope angle corresponding to a slope angle of the rafters, the combined transverse distance across the sloped mounting surfaces being approximately three inches.

4. The structural framing system according to claim 1 wherein the top mounting surface of the eave girt has a slope angle which corresponds with a slope angle the rafters, the combined transverse distance across the sloped mounting surfaces being approximately three inches, said top mounting surface and said support surface being located a common height above the rafters and in a common plane such that an external roof structure can be equally supported by the eave girt and the face board.

5. The structural framing system according to claim 1 wherein the eave girt has a beveled edge having a slope angle corresponding to a slope angle of the rafters;

said mounting surface of said eave girt providing at least three inches of attachment surface width for securing an exterior roof structure.

6. For a structural framing system for a building which includes a plurality of dual roof truss members and upstanding support columns comprising multiple support members extending through and coupled to the dual roof truss members, each truss member comprising opposed sloping rafters and an interconnecting joist, the rafters being connected to one another at an apex and sloping downwardly away from one another and terminating at opposite lower ends of the truss member, the rafters aligned to create sloped top surfaces for attaching an exterior roof structure, the joists coupled to the lower ends of the rafters, and a plurality of cross brace members secured between said dual roof trusses, said cross brace members providing lateral support to the building structure and providing an outer support surface for attaching an exterior roof structure, the cross brace members comprising T-purlins, each T-purlin having a face board and a cross brace board, the face boards extending across the dual roof truss members and being secured to the top of both rafters of said dual truss members, each cross brace board being secured between adjacent dual trusses, an eave girt comprising:

a girt block having a first height and a first top, mounting surface for securing an exterior roof structure;

a cornice piece coupled to the board coupled to the girt block at said first height, said cornice piece having a second top, mounting surface for securing an exterior roof structure;

said first and second mounting surfaces lying in substantially the same plane such that an exterior roof structure can be mounted upon the combined first and second mounting surfaces.

7. The eave girt according to claim 6 wherein said first and second mounting surfaces are sloped at an angle corresponding to the slope of the rafters such that an external roof structure is supported by the entire surface area of said first and second mounting surfaces.

8. The eave girt according to claim 6, further comprising:

a flashing piece coupled to and substantially covering the cornice piece for protecting the eave girt from damage due to environmental elements.

9. The eave girt according to claim 6, further comprising:

a flashing piece coupled to and substantially covering the cornice piece for protecting the eave girt from damage due to environmental factors, the flashing piece being preformed to contour the girt block and the cornice piece.

10. For a structural frame of a building having a plurality of dual roof trusses, each truss comprising rafters and joists, the rafters being connected to one another at an apex and sloping downwardly away from one another and terminating at lower ends, the rafters forming a sloped outer surface, the joists coupled to the lower ends of the rafters, and a plurality of cross brace members secured between said dual roof trusses, said cross brace members providing lateral support to the building structure and providing an outer support surface for attaching an exterior roof structure, the cross brace members comprising T-purlins, each T-purlin having a face board and a cross brace board, the face boards extending across the dual roof truss members and being secured to the top of both rafters of said dual truss members, each cross brace board being secured between adjacent dual trusses, an upstanding support column assembly comprising:

a first and second outer support members, said first and second outer support members including respective support surfaces for supporting the vertical load of said dual roof truss;

an inner support member extending through said dual trusses and having a sloped top surface which corresponds to the slope of the rafters;

said first and second outer support members securing the inner support member therebetween;

said inner support member extending through said lower ends of said rafters such that said sloped top surface lies in a plane that corresponds substantially with sloped outer surface of the rafters;

a fastener securing the inner support member to the rafters;

said inner support member providing vertical and lateral support to said truss member.

11. The upstanding support column assembly according to claim 10 wherein the outer and inner support members are completely chemically treated along their entire respective lengths and throughout the entire midportions thereof.

12. The upstanding support column assembly according to claim 10 wherein the outer and inner support members are completely chemically treated along their entire respective lengths and throughout the entire midportions thereof, the inner and outer support members being laminated to one another.

* * * * *